US008877047B2

(12) United States Patent
Stroeder

(10) Patent No.: US 8,877,047 B2
(45) Date of Patent: Nov. 4, 2014

(54) DRAG POOL MESH SKIMMER

(71) Applicant: Gary J. Stroeder, Kelowna (CA)

(72) Inventor: Gary J. Stroeder, Kelowna (CA)

( * ) Notice: Subject to any disclaimer, the term of this patent is extended or adjusted under 35 U.S.C. 154(b) by 77 days.

(21) Appl. No.: 13/708,985

(22) Filed: Dec. 8, 2012

(65) Prior Publication Data

US 2014/0158595 A1 Jun. 12, 2014

(51) Int. Cl.
*E04H 4/16* (2006.01)

(52) U.S. Cl.
CPC ..... *E04H 4/1609* (2013.01)
USPC ..... 210/167.2; 210/167.19

(58) Field of Classification Search
CPC ..... E04H 4/1609
USPC ..... 210/167.19, 167.2, 232, 238
See application file for complete search history.

(56) References Cited

U.S. PATENT DOCUMENTS

| | | | | |
|---|---|---|---|---|
| 4,369,109 | A | 1/1983 | Edge | |
| 4,472,842 | A * | 9/1984 | Jarrett | 4/490 |
| 4,518,495 | A * | 5/1985 | Harding | 210/470 |
| 5,043,060 | A | 8/1991 | Brennan | |
| 5,223,135 | A | 6/1993 | MacPhee et al. | |
| 5,614,085 | A * | 3/1997 | Platt, III | 210/232 |
| 5,759,388 | A * | 6/1998 | Cote | 210/167.2 |
| 5,849,184 | A * | 12/1998 | Veillet | 210/167.2 |
| 7,815,797 | B1 | 10/2010 | Keith | |
| 7,972,504 | B2 | 7/2011 | Weiss | |
| 2004/0108259 | A1 * | 6/2004 | Giannantonio | 210/169 |

* cited by examiner

*Primary Examiner* — Fred Prince
(74) *Attorney, Agent, or Firm* — Mark V. Loen

(57) ABSTRACT

The invention comprises a net stretched across the pool surface, either partially or completely, and a pull chord attached to either end. Each pull cord is operated by an individual. The upper edge of the net is attached to a float and the lower edge is weighted to ensure it submerges below the water surface. Two side edges of the net are incorporate a spreader bar to create separation between the top and bottom of the net to create maintain an opening to captures water surface debris.

4 Claims, 4 Drawing Sheets

DRAG POOL MESH SKIMMER

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR COMPUTER PROGRAM LISTING

Not applicable.

BACKGROUND OF THE INVENTION (1) Field of the Invention

This invention is directed toward convenient skimmers for surfaces of swimming pools. It is particularly directed toward skimmers that are pulled across the water surface for the purpose of pulling out major debris in a net type of filter and then disposing the captured debris after removal.

(2) Description of Related Art

Important aspects of surface pool cleaning are convenience, the ability to complete the task of surface cleaning in an expeditious manner, and debris handling. Most pools have cleaning systems which involve pumps and filters that intermittently or continuously operate to keep the water clean. Most of the filtration systems have intakes that are either below the water line or are an overflow type system. They usually do not remove surface debris to a satisfactory level.

As a practical matter, it falls upon the pool owner to manually remove major debris which floats on the surface prior to using the pool. Normally, twigs, bugs, leaves, small animals such as frogs, etc. are on the surface of the pool and a swimmer will want to remove the debris before swimming. Such debris can inadvertently float into hair or a mouth, or adhere to the body spoiling the fun of swimming. Eventually, debris can also become heavy with water and sink to the bottom of the pool, making it harder to remove.

Another consideration is that when a swimmer desires to enjoy the benefits of a swimming pool, it is important that the skimming operation is as convenient and quick as possible. The use of a small surface area on a handle is a common method of skimming but takes a lot of time when there is a large surface area to clean. For example, U.S. Pat. No. 5,342,513 discloses a basket type skimmer on the end of a long handle. Other similar designs are commercially available. The time required for removing the debris, dumping the basket, and repeating can be unsatisfactory for someone who wishes to spend their time swimming rather than cleaning.

Others have developed skimmers that move through the water for debris removal. U.S. Pat. No. 5,223,135 describes a stiff frame with a net that is pulled through the water to remove debris. This frame lacks convenience and compactness when skimming a long surface area. It is also difficult to maneuver when skimming oddly shaped pools. U.S. Pat. No. 5,043,060 has similar difficulties and is also awkward to clean out.

U.S. Pat. No. 4,369,109 describes a skimming frame that is attached to the side of a pool. The frame does not move and water flows through the skimmer by pumping means. This may be satisfactory when it is possible to provide the additional equipment that provides the water motion. However, this method is complicated, expensive, and of limited applications where the pool shape allows the pool surface to be skimmed by a fixed point surface skimmer.

What is needed is the ability to quickly clean off the surface of a swimming pool, conveniently dispose of the debris, and avoid expenses and complications of other designs.

BRIEF SUMMARY OF THE INVENTION

The invention comprises a net stretched across the pool surface, either partially or completely, and a pull chord attached to either end. Each pull cord is operated by an individual. The upper edge of the net is attached to a float and the lower edge is weighted to ensure it submerges below the water surface. The two side edges are attached to a wire or a frame that is bent to cause the net to naturally bow in a way to capture surface debris as the net is pulled through the water.

It is an object of the invention to provide a pool skimming device which is economically produced and marketed.

It is another object of the invention to provide a pool skimming device which is lightweight, compact for storage, and durably constructed.

It is another object to remove pool surface debris in two to three passes, typically requiring five to six minutes for an average pool up to 18 feet by 36 feet.

It is another object to provide for use of two people to provide the skimming labor, and allow the easy disposal of removed debris from the skimmer net.

Other objects and advantages will become apparent when the invention is further described in the figures and claims.

BRIEF DESCRIPTION OF THE SEVERAL VIEWS OF THE DRAWING(S)

DETAILED DESCRIPTION OF THE INVENTION

Figures 1A, 1B, 1C:
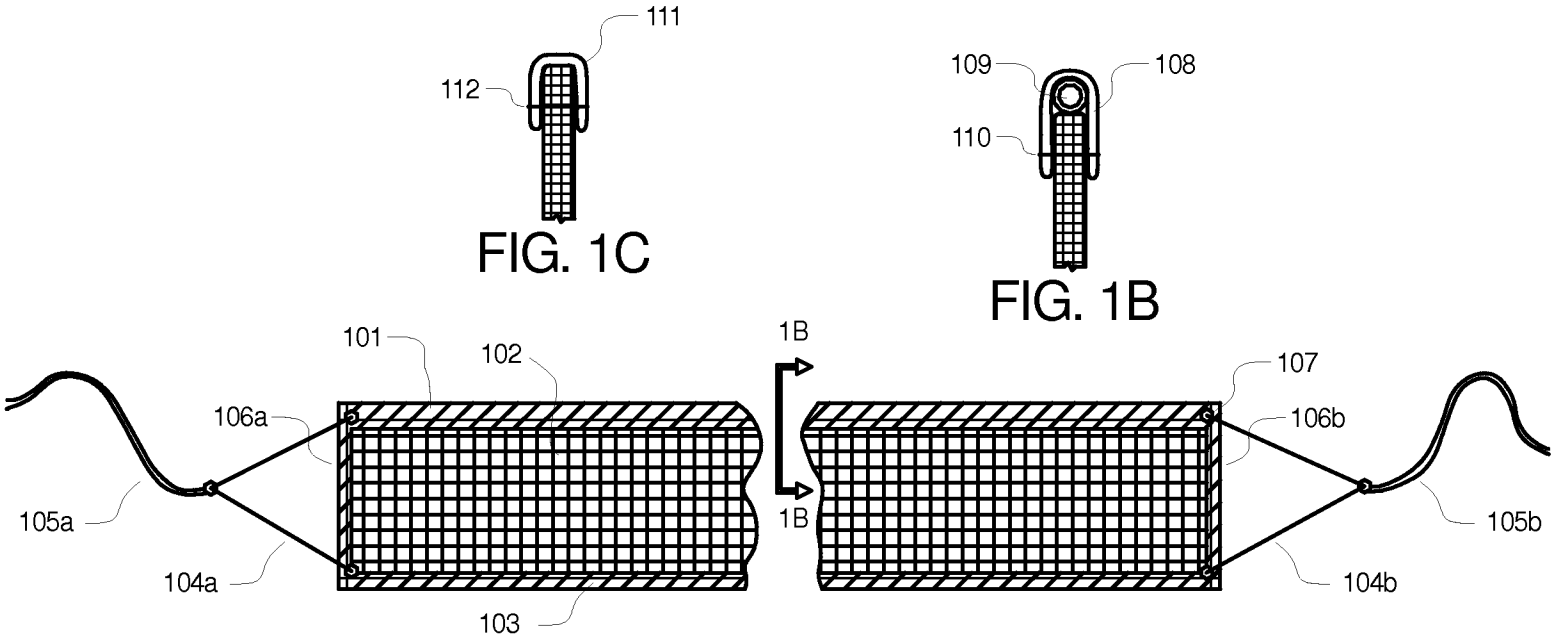
FIGS. 1A-1C shows a front view of the net and a detail of how the edge is sewn.

A typical skimmer assembly is shown in FIG. 1A. A rectangular skimmer net is installed inside a sewn flexible frame that is pulled through the water. The flexible frame comprises a top floatation edge 101 that is attached to the rectangular skimmer net 102, which in turn, is attached to a lower weighted edge 103. The top edge is designed to float to ensure that it will stay on top of the water when the assembly is pulled across the water surface. The lower edge is weighted to ensure it readily will stay below the surface of the water. The two side edges 106*a,b* are reinforced with additional material and allow the skimmer net 102 to be bowed in a way to ensure that the surface debris will be captured in the skimmer net. Pull ropes 105*a,b* are used to pull the skimmer assembly through the water.

FIG. 1B shows a detail cross section of the upper edge. An outer material 108 is used to capture a floatation material 109 and then it is sewn together 110 along with the net. The entire perimeter of the skimmer net is sewn with the outer material. The outer material is a flexible material, that is preferably resistant to UV and pool chemicals. The lower edge is similarly made and captures the weight.

FIG. 1C shows a detail of the two skimmer net edges where a protective strapping 111 is sewn 112 over the net material. If the protective strapping is not used, it will result in an early degradation of the skimmer net material. The edge strapping provides strength to the sides of the surface skimmer so that the spreader bars (discussed later) can generate the needed force to open the net during the skimming operation.

Figure 2A:
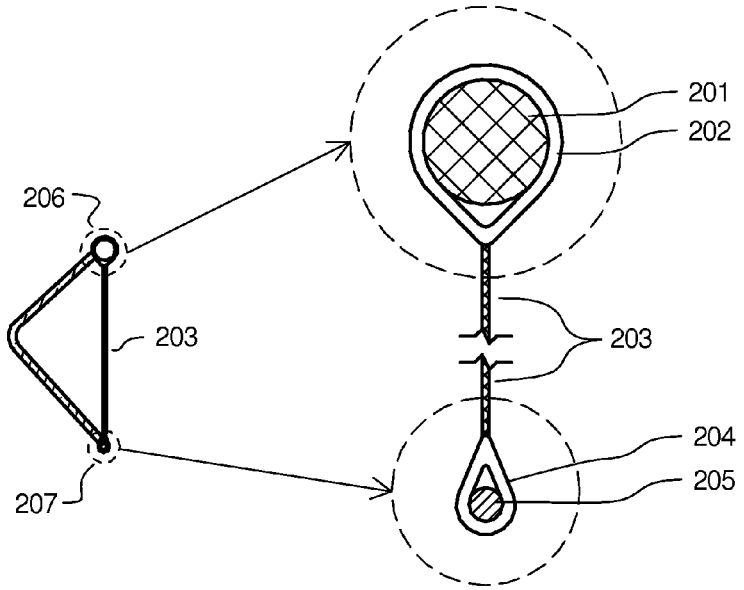
FIGS. 2A-2D show a cross section of the net and end view with a detailed view of the upper and lower edges.
Figure 2B:
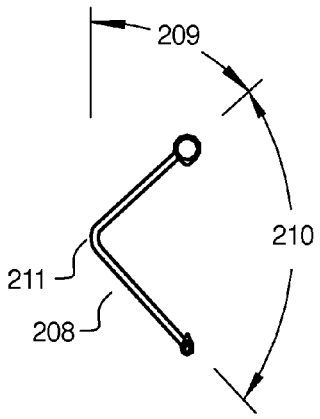

FIG. 2A-2D further illustrates additional details of the assembly construction. FIG. 2A is a cross section through the skimmer met and FIG. 2B is an end view. The top edge comprises a flotation 201 which is a round, lengthwise edge of a light weight material, such as plastic that will float on water. It is preferably the kind of material that will take repeated use with out damage. In this embodiment, an upper strap 202 is used to attach the skimmer net 203 to the floatation material. The skimmer net 203 can be looped around the flotation 201 to enhance attachment. The strapping is also preferably a light weight plastic material. The skimmer net is preferably made of a plastic or fiber material, and as an additional embodiment, includes suitable outdoor protection from the sun and pool chemicals. The lower edge incorporates a weighted material 205 that is a heavier material, such as an elongated wire, coated wire, spaced weights, or a plastic coated metal band. The skimmer net 203 is attached to the enlongated cylindrical weight 205 by use of a lower strap 204, similarly to the top edge. The skimmer net 203 can be looped around the weight 205 to enhance attachment.

The side edge preferably incorporates a separate spreader bar 208 that is bent so that the angle from vertical is substantially 45 degrees, symmetrical to vertical and the midpoint. Or, to put it another way, the inside angle 210 formed by bending is a right angle, and the angle opening faces the intake side of the skimmer net. The angle preferably has a small radius 211 as opposed to a sharp corner, as shown. The skimmer net is not directly attached to the spreader bar. Instead, the net is attached to the upper and lower edges, and the spreader bars are used to provide additional support and stiffening.

In a preferred embodiment, the spreader bars are attached to the netting through a metal grommet. The spreader bars are either loosely hooked in and provide vertical separation tension to the skimmer net, or they are rigidly attached. If they are hooked in, the spreader bars have freedom to align with the flow in the pool water as the netting is pulled. The primary function of the spreader bars is to provide a vertical separation distance between the metal grommets, that is, the distance between the top and bottom edges, to ensure the netting stays open during the skimming operation.

If the spreader bar was not used in this invention, the top and bottom of the netting would collapse together when the skimmer net is pulled through the water. If the skimmer net collapsed on itself, it becomes unusable for skimming debris off of the water.

In a preferred embodiment, the spreader bar is an angled or arched piece of material, which gives it a spring like tendency. It is made of a coated metal, plastic, fiberglass of other flexible material that will withstand a water environment. The spreader bars are longer than the width of the skimmer net height before they are bent into shape, and are attached to each end of the skimmer net by flexing them so that one of the ends of one Spreader Bar fit into the upper edge grommet and the other end fits into the bottom edge of grommet. They are attached on the back or trailing side of the Surface Skimmer when it is pulled through the water.

Figure 2C:
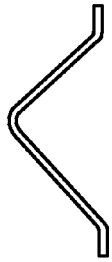
Figure 2D:
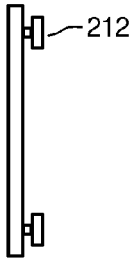

FIG. 2C shows the spreader bar with ends that provide the ability to hook into metal grommets. FIG. 2D shows a much stiffer spreader bar without the spring effect with protruding buttons 212 that attach to the metal grommets. In this case, the material must be carefully selected so that unnecessary side edge weight is not added to the skimmer net. A composite material that provides the proper amount of flotation and strength is desirable.

In another embodiment, the spreader bars are a much stiffer frame, and provide separation between the top and bottom edges. In this case, the spreader bars are not flexed and are rigidly attached to the skimmer net in a way to keep the top and bottom edges separated at the sides.

Figure 3:
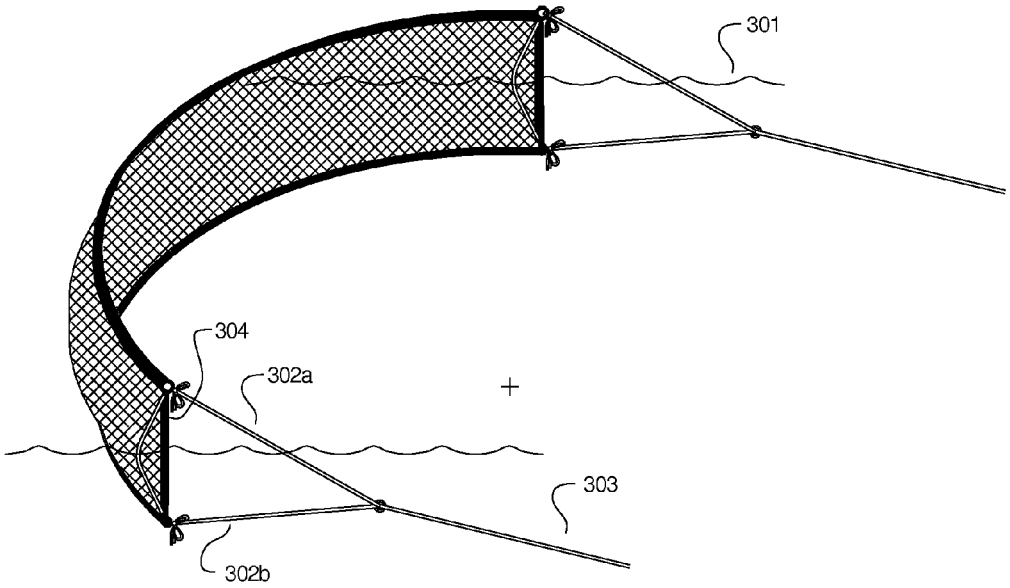
FIG. 3 shows the when net in use.

FIG. 3 shows the skimmer assembly in actual use where it is pulled across the surface of a water 301 and the skimmer net is bowed out by the water pressure against the intake side of the net. Preferred mesh opening in the skimmer net are 0.6 to 2.0 mm. This is fine enough to capture nearly all particles that would disturb a swimmer.

The attachment ropes are designed to create a triangle between the side edges 304 and the pull ropes 303 so that the net pulls evenly between the top and bottom edges through the water. The preferred design is to have the same length 302*a,b* from the top floatation edge to the pull rope and the bottom edge to the pull rope.

Figure 4:
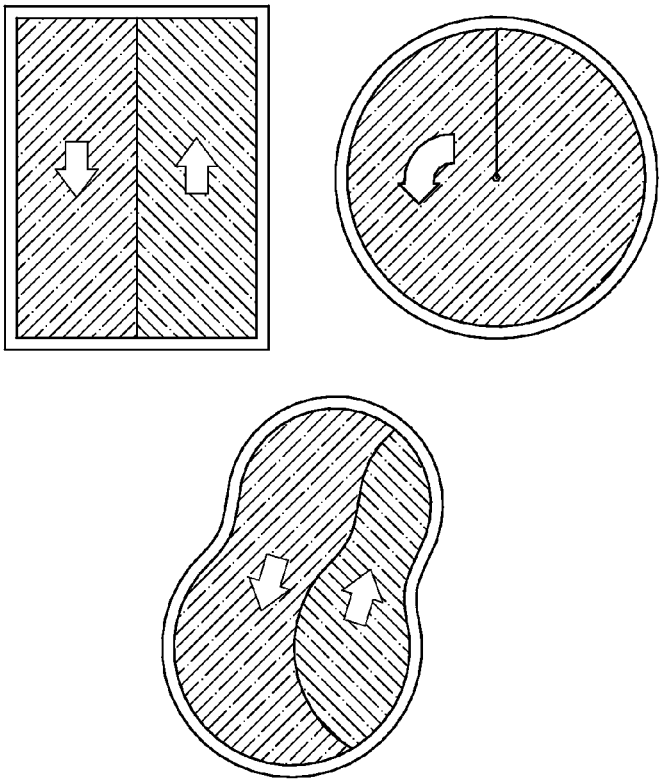
FIG. 4 shows how various shaped pools would be cleaned by use of the net system.

FIG. 4 shows the cleaning sweep strategy for a typical rectangular, round, and irregular shaped pool. If the skimmer net length is at least half of the width of the pool, the length of the pool only has to be walked twice and the pool surface is clean. For most cleaning situations, the pool surface skimmer should be pulled out of the pool to remove captured debris after each pass to prevent debris from escaping from the surface skimmer for subsequent passes. A typical size swimming pool can be completely cleaned in five to six minutes.

The two pull ropes on either side of the skimmer net are controlled by two operators who walk and pull the skimmer net across the surface of a pool. However, it is preferred to use two operators for the sake of rapid cleaning. Also, to ensure the surface debris close the pool sides is cleaned out, it is easier for a two person operation. In this case, one operator will use a short pull rope and keep one side of the net close to the pool side. The other operator will use a long pull rope and walk on the other side of the pool. By use of the two person method, the design makes it is possible to clean within one inch of the side of a pool. A two person operation is also better from a pool safety standpoint.

Figure 5A:
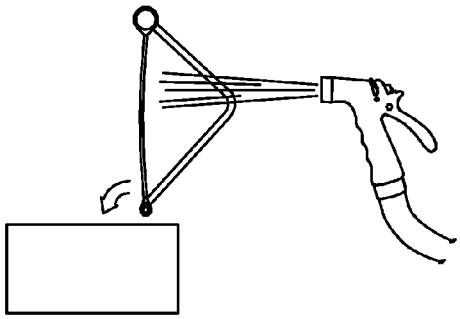
FIGS. 5A-5B illustrate simple methods of disposing trapped debris.
Figure 5B:
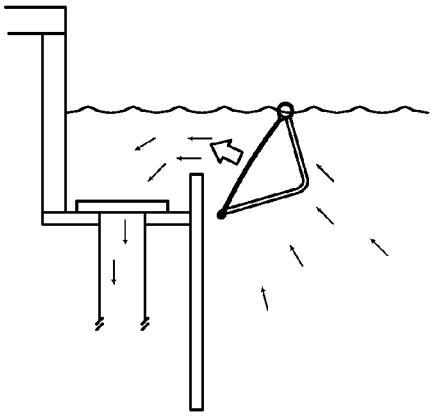

FIGS. 5A-5B show two examples of how the skimmer net is cleaned out. FIG. 5A shows how the skimmer net is cleaned out by reverse spraying with a garden hose into a waste container. FIG. 5B shows how the surface overflow inside a pool is used to clean the skimmer net, provided the water flow is strong enough. Other methods are also employed such as manually shaking the net, blowing the net out with air, and scraping the net.

While various embodiments of the present invention have been described, the invention may be modified and adapted to various operational methods to those skilled in the art. Therefore, this invention is not limited to the description and figure shown herein, and includes all such embodiments, changes, and modifications that are encompassed by the scope of the claims.

I claim:

1. A pool surface skimmer assembly comprising:

A) a rectangular skimmer net comprising:

1) a top edge incorporating a floatation material and a top strap that is UV resistant, 2) a bottom edge incorporating a weighted material and an optional bottom strap, and 3) two side edges, a) wherein said side edges each incorporate a spreader bar, b) wherein each said spreader bar maintains a predetermined distance between said top edge and said bottom edge, and c) wherein said side edges incorporate protective strapping, B) wherein mesh openings in said skimmer net are 0.6 to 2.0 mm, C) two pull ropes, D) attachment ropes, wherein said attachment ropes connect said pull ropes to said side edges, E) wherein the attachment rope lengths are chosen so that the distance i) between said pull ropes and said top edge, and ii) between said pull ropes and said bottom edge, are the same, and F) wherein said skimmer net is designed to be pulled in either direction.

2. A pool surface skimmer assembly according to claim 1 wherein said skimmer net is cleanable by use of a garden hose.

3. A pool surface skimmer assembly according to claim 1 wherein the design of said pool surface skimmer assembly provides for cleaning of said pool to within one inch of the edge by two operators.

4. A pool surface skimmer assembly according to claim 1 wherein a flexible frame incorporates said top edge and said bottom edge.

* * * * *